US006901632B2

(12) United States Patent
Boyce

(10) Patent No.: US 6,901,632 B2
(45) Date of Patent: Jun. 7, 2005

(54) COUPLING ASSEMBLY

(75) Inventor: Dean Arden Boyce, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/662,866

(22) Filed: Sep. 15, 2003

(65) Prior Publication Data

US 2005/0055803 A1 Mar. 17, 2005

(51) Int. Cl.[7] ..... E05D 15/50

(52) U.S. Cl. ..... 16/231; 16/227; 220/841; 220/323; 220/324

(58) Field of Search ..... 16/231, 227; 220/841, 220/780, 323, 324

(56) References Cited

U.S. PATENT DOCUMENTS

| | | | | |
|---|---|---|---|---|
| 4,091,962 | A * | 5/1978 | van Buren, Jr. | 220/326 |
| 4,212,415 | A * | 7/1980 | Neely | 222/231 |
| 4,724,579 | A | 2/1988 | Ng | 16/260 |
| 5,100,015 | A * | 3/1992 | Vanderstuyf | 200/326 |
| 5,551,589 | A * | 9/1996 | Nakamura | 220/326 |
| 5,893,480 | A * | 4/1999 | Dore et al. | 220/784 |
| 5,931,514 | A * | 8/1999 | Chung | 292/89 |
| 6,186,357 | B1 * | 2/2001 | Kyle | 220/841 |
| 6,328,355 | B1 * | 12/2001 | Bortz | 292/307 R |

OTHER PUBLICATIONS

John Deere Parts Catalog "4020 Tractor"; 2 pgs; Oct. 18, 1994.

"Current 5X20 Load Center Cover Latch", 2 pages, date unknown.

"Latch Prior Art", 2 pages, date unknown.

* cited by examiner

*Primary Examiner*—Suzanne Dino Barrett
*Assistant Examiner*—Mark Williams

(57) ABSTRACT

One or more coupling assemblies are located at each opposite end of a first part and a second part. Each coupling assembly includes an elongated slot formed in the first part and a corresponding latch device which projects from the second part and which is releasably receivable by the slot. The latch device includes a tab and a pair of spaced-apart fingers projecting from the second part. The tab is positioned between the fingers. The fingers project generally linearly and parallel with respect to each other, and define a plane. The tab has a base, a first leg and a second leg. The base extends generally parallel to the fingers. The first leg extends away from the plane and from a first end joined to the base to a second end joined to the second leg. The second leg and extends towards the plane and away from the second end of the first leg. The first and second legs form an apex which is spaced apart from the plane of the fingers. The first part forms a pair of ramp surfaces adjacent to the ends of each slot. The ramp surfaces engage the fingers to help guide the latch device into the slot. The second leg engages an edge of the slot when the latch device is being inserted into the slot, and the tab deflects towards the plane as the latch device is inserted into the slot. The fingers engage the end walls of the slot and deflect towards each as the latch device is inserted into the slot. The first leg engages an edge of the slot when the latch device is fully received by the slot, and the tab is biased to urge the latch device into the slot.

19 Claims, 5 Drawing Sheets

38
14
44
40
50
46
42
34
36
20
10
62
60
64
16
18
12

COUPLING ASSEMBLY

BACKGROUND

The present invention relates to a coupling or latching assembly for removably coupling separate parts together, such as cover or panel or housing parts on a vehicle.

Cover panels on agricultural equipment have traditionally been attached with fastening hardware or latches which must be attached to the panel to facilitate mounting the panel on the vehicle. Such hardware is expensive, and labor is required to install such parts on the vehicle and subassemblies. When a cover is to be installed on a vehicle, such hardware must be carefully aligned so that the cover can be mounted correctly and retained securely during field operations. In some cases, the installation and function of the latch hardware may be compromised if the panels and mating parts do not have uniform wall thickness at the attaching points.

SUMMARY

Accordingly, an object of this invention is to provide a simple and inexpensive coupling mechanism for attaching two housing parts together.

A further object of the invention is to provide such a coupling mechanism which permits one of the housing parts to be removed from the other part.

A further object of the invention is to provide such a coupling mechanism which permits one of the housing parts to be pivoted with respect to the other part.

These and other objects are achieved by the present invention, wherein coupling assembly for coupling a first part to a second part includes a plurality of elongated slots formed in the first part and a plurality of latch devices projecting from the second part. Each latch device is releasably receivable by a corresponding slot. Each latch device includes a pair of spaced-apart fingers and a tab projecting from an outer portion of the second part. The tab is positioned between the fingers. The fingers define a plane which faces generally away from a main portion of the second part. The tab has a base, a first leg and a second leg. The base projects from the second part in a direction generally parallel to the fingers. The first leg extends away from the plane from a first end joined to the base to a second end joined to the second leg. The second leg extends towards the plane and away from the first leg. Each latch device pivotally couples the second part to the first part, whereby either end of the second part may be lifted away from the first part. The first leg engages an edge of the slot when the latch device is fully received by the slot, and the tab is biased to urge the latch device into the slot. All the latch devices can be removed from their corresponding slots to completely remove the second part from the first part. Each latch device pivotally couples the second part to the first part, so that either end of the second part may be pivoted and lifted away from the first part.

DETAILED DESCRIPTION

Figure 1:
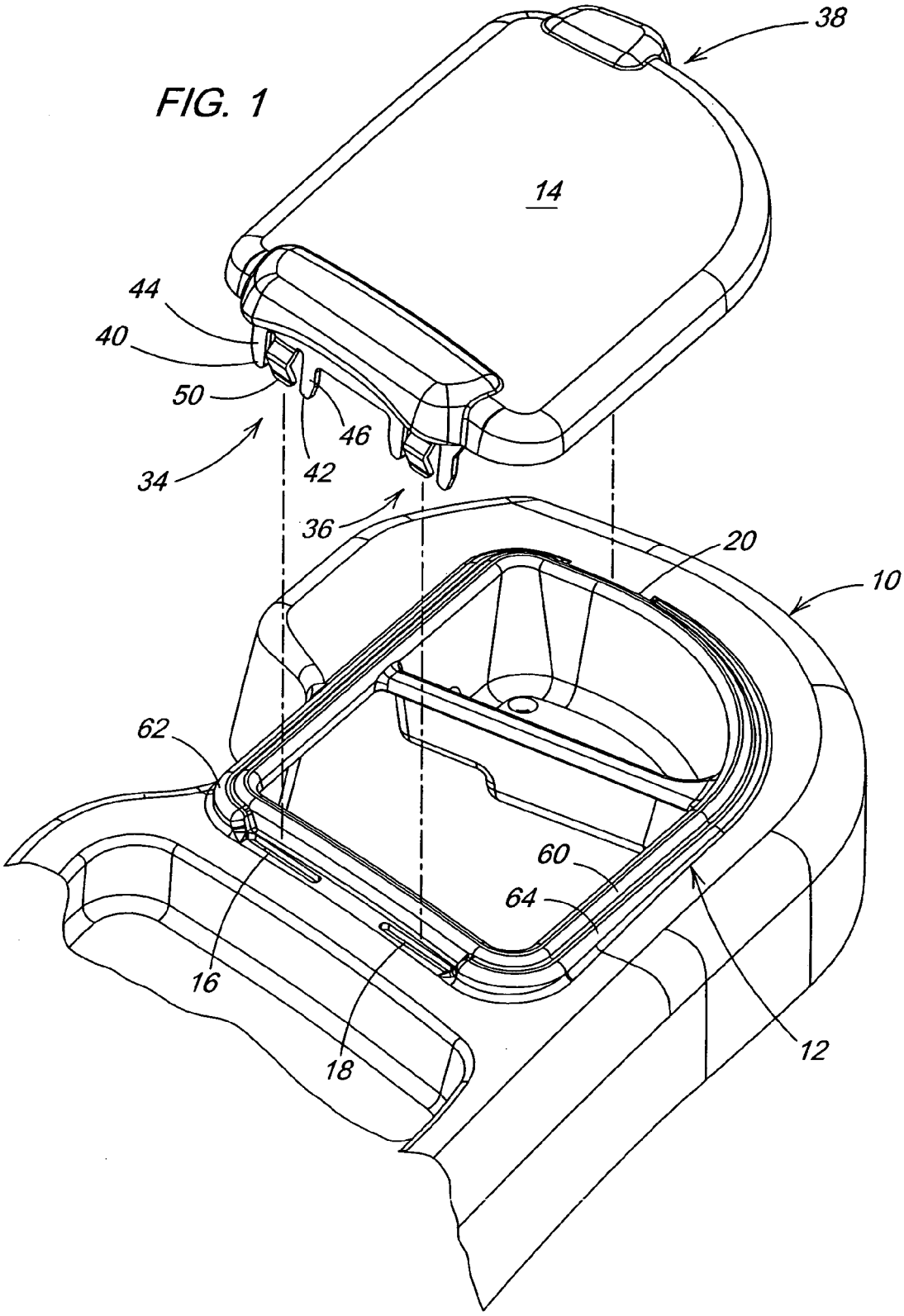
FIG. 1 is a perspective view of a panel latch assembly according to the present invention.
Figure 2:
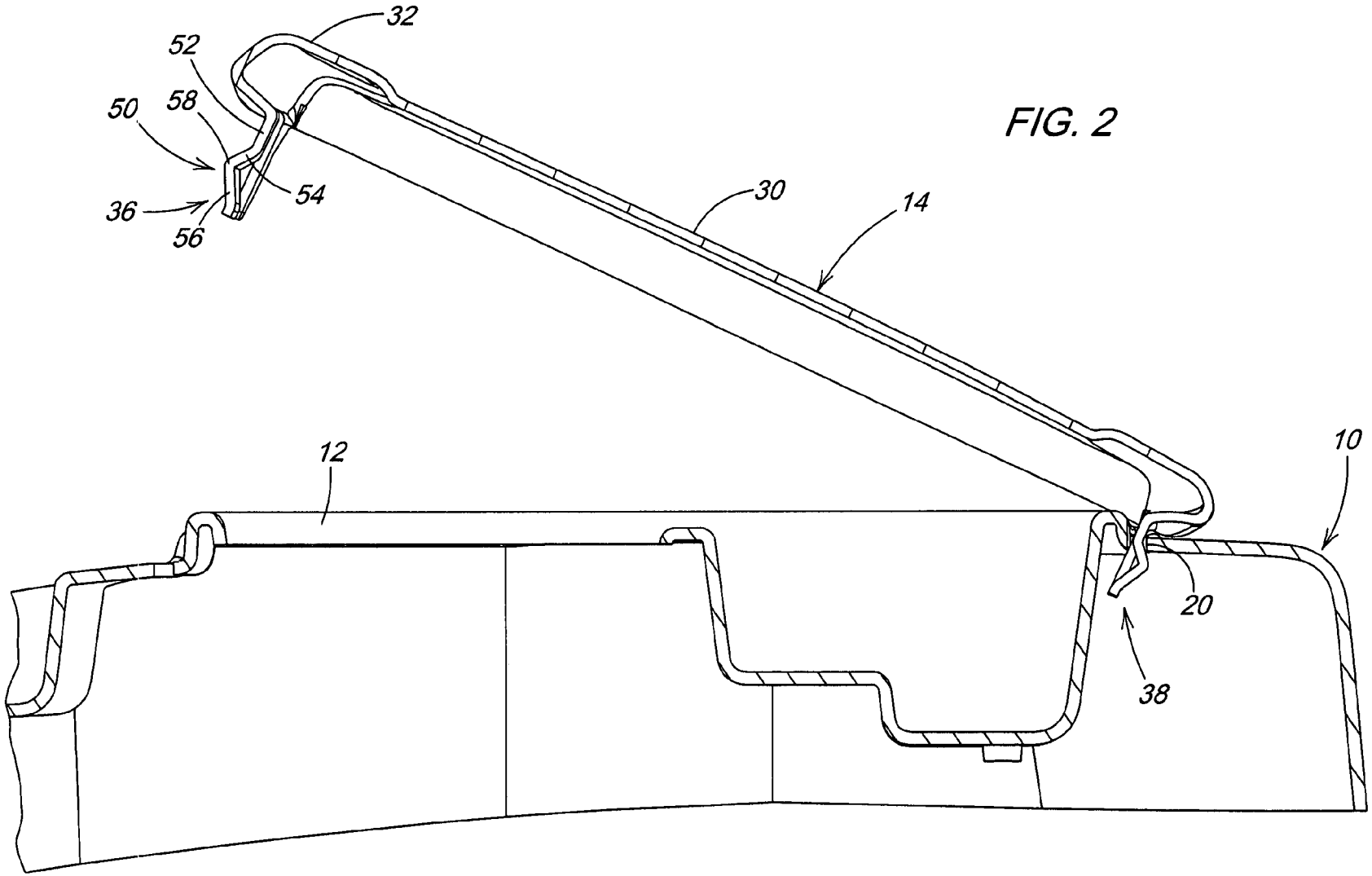
FIG. 2 is a sectional view of the present invention with the panel in a tilted position.
Figure 3:
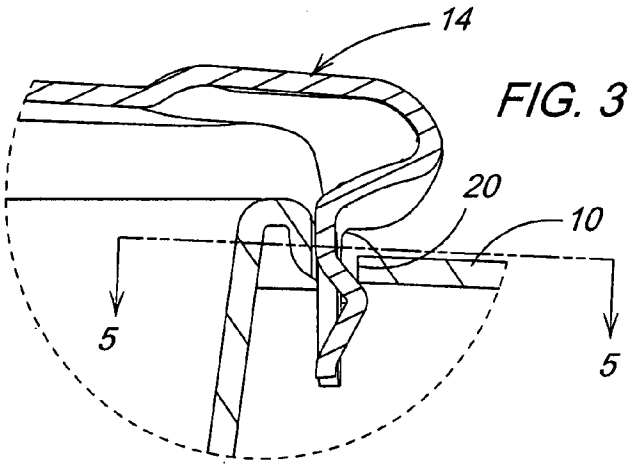
FIG. 3 is a sectional view of the present invention with the panel in a closed position.
Figure 4:
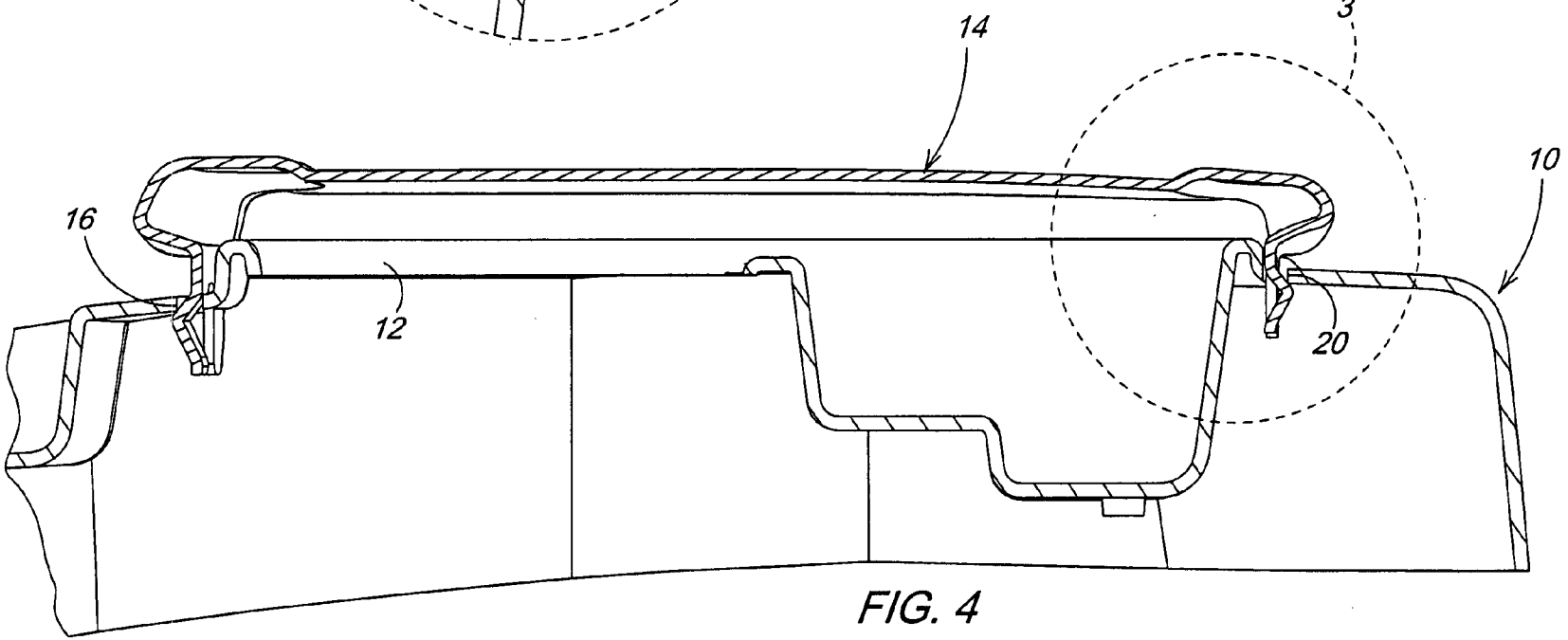
FIG. 4 is an enlarged view of a portion of FIG. 3.
Figure 5:
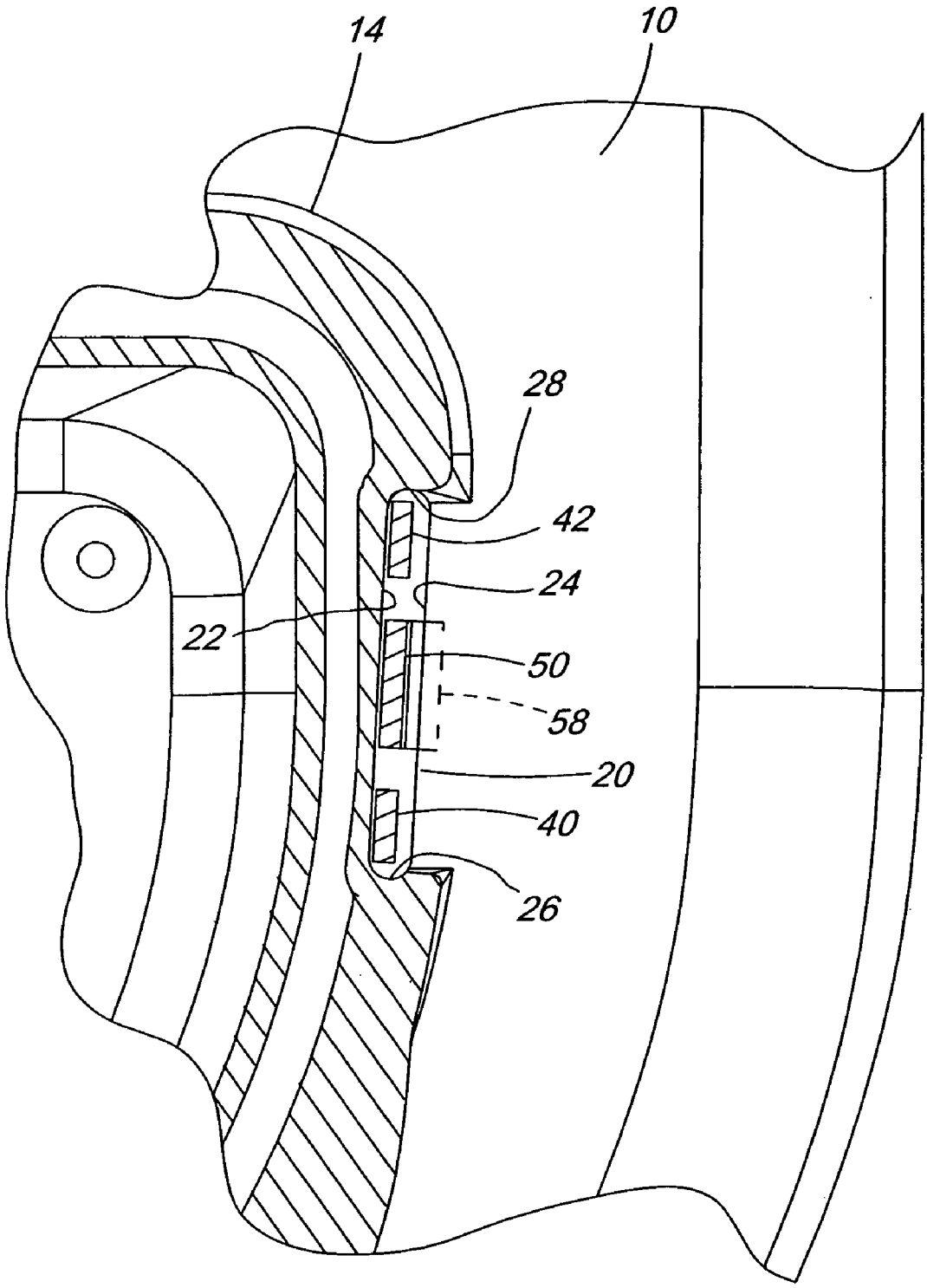
FIG. 5 is a sectional view along lines 5—5 of FIG. 4.

Referring to FIGS. 1, 2 and 3, a first housing or panel 10 has a section or opening 12 to be covered by a cover panel 14. A plurality of elongated slots 16, 18 and 20 are formed in panel 10 adjacent to opening 12. Referring now to FIGS. 4 and 5, each slot has first and second spaced apart substantially parallel side walls 22, 24 joined together at opposite ends thereof by a pair of end walls 26, 28. From FIGS. 3, 4 and 5 it is seen that panel 10 forms a plate 11 which surrounds and extends away from the opening 12. Slot side wall 24 forms an inner edge of a portion of plate 11. A portion of plate 11 adjacent to side wall 24 extends only outwardly away from the slots 16–20 and extends generally perpendicularly to a surface of side wall 24.

The panel 14 has a main body 30, an outer portion 32 surrounding the body 30, and a plurality of latches 34, 36 and 38 which project from opposite ends of the outer portion 32.

As best seen in FIGS. 1, 4 and 5, each set latch 34–38 has a pair of spaced apart fingers 40, 42 which project generally linearly and parallel with respect to each other. The fingers having outer surfaces 44, 46 which define a plane and which face generally away from a main body 30. A tab 50 is positioned between each pair of fingers. Each tab 50 has a base 52, a first leg 54 and a second leg 56. The base 52 projects from panel 14 in a direction generally parallel to the fingers 40, 42. The first leg 54 projects away from the base 52 and away from the plane defined by fingers 40, 42. Each first leg extends from a first end joined to the base 52 to an outer end which is joined to the second leg 56. Each second leg 56 extends away from the leg 54 and towards the plane defined by fingers 40, 42. Thus, legs 54 and 56 form an apex 58 which is spaced outwardly apart from the plane of fingers 40, 42.

The outer fixed fingers 40, 42 have flat planar surfaces which engage the long edge of the corresponding slot 20. As each latch 34, 36 and 38 is inserted into a corresponding slot 16, 18 and 20, each middle tab 50 deflects, pivots or hinges as the apex 58 engages and moves past the edge of the corresponding slot. The outer edges of the fingers 40, 42 are angled to aid in locating and installing the latches 34–38 within the slots 16–20. The outer end of the middle tab 50 is aligned with the outer ends of the fingers 40, 42 to help insure that the middle tab 50 enters the slot along with the fixed fingers 40, 42.

As each latch is inserted into the corresponding slot, the fingers 40, 42 engage and slide across one side of the slot as the second leg 56 engages the opposite side of the slot and causes the apex 58 of the tab 50 to deflect towards the fingers 40, 42. After the apex 58 passes through the slot, the tab 50 partially rebounds and the first leg 54 and engages the bottom edge of the slot (as best seen in FIG. 4). Preferably, the parts are dimensioned so that the tab 50 does not completely rebound or return to its undeflected starting position. As a result, the still partially deflected tab 50 is biased to exert a force on the bottom edge of the slot which tends to pull or clamp the cover 14 towards the housing 12. The amount of pull of clamping force can be varied by varying the size and shape of the various parts.

Figure 6:
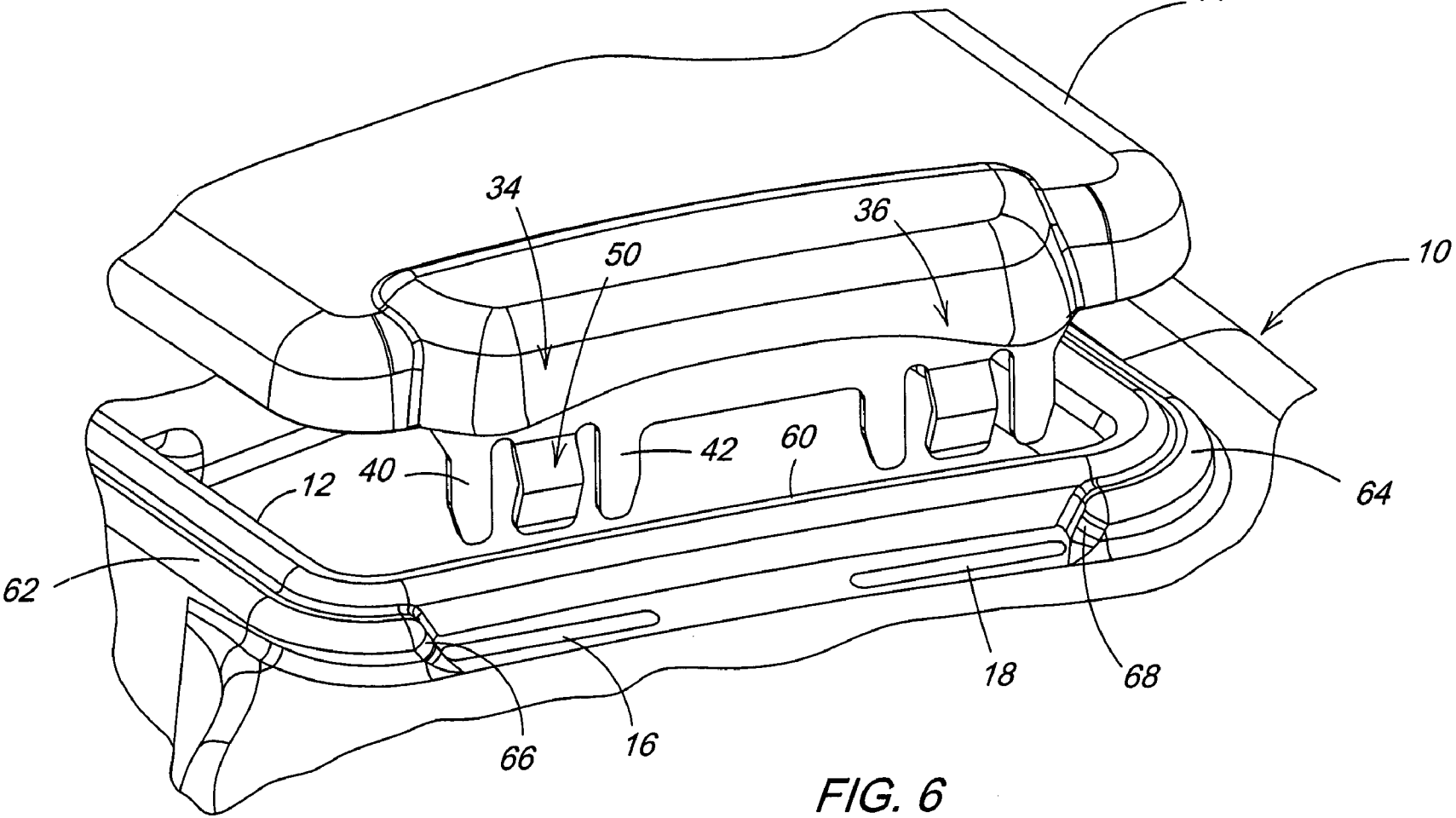
FIG. 6 is an enlarged perspective view of a portion of a panel latch assembly according to the present invention.

As best seen in FIG. 6, the housing 10 has an inner raised rim 60 which surrounds the opening 12 and an outer rims 62 and 64. Outer rim 62 has a slanted end or ramp surface 66 which extends upwardly and away from the outer end of slot 16. Outer rim 64 has a slanted end or ramp surface 68 which extends upwardly and away from the outer end of slot 18, and which faces generally towards surface 66. Surfaces 66 and 68 help to align and guide the latches 34, 36 into their respective slots 16, 18 for easy installation. Although not illustrated, the rims 62 and 64 also preferably form similar ramp surfaces at opposite ends of slot 20.

Each latch 34, 36 and 38 thus performs latch, tension, and release functions. The latches are located on opposite ends of the cover 14 and each defines a hinge axis about which the cover 14 can pivot so that either end of the cover 14 may be lifted. The latches on the end of the cover 14 being lifted are removed from their corresponding slots while the latches on the other end of the cover 14 remain pivotally retained within their slots. The cover 14 may also be totally removed from the housing 10 by lifting both ends of the cover 14 together to removing all the latches 34–38 from the slots 16–20. As best seen in FIG. 2, each latch 34, 36, 38, when fully inserted in the slots 16, 18 and 20, is pivotally engagable with the slot side walls 22, 24 and is pivotal with respect to the side walls 22, 24.

The latches may be placed on either the cover 14 or the panel 10 with the slots formed in the other part. The latches may be produced using known available pressure—forming technology. The cover and latches could be produced by a number of other technologies and provide similar functionality. Preferably, all of the latches are produced in the forming and trim operations used to produce the cover and mating panel. All the elements are integral with the cover 14 and the panel 10, and no separate parts are needed. This coupling assembly is simple to use, inexpensive and reliable. Since latches and slots are placed at both ends of the panel 10 and the cover 14, the cover 14 can function as a hinged lid with either end capable of being opened for easy access to compartments under the cover 14.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A coupling assembly for coupling a first part to a second part, comprising:

an elongated slot formed in the first part, the slot having first and second spaced apart substantially parallel longer side walls joined together at opposite ends thereof by a pair of shorter end walls; and a latch device projecting from the second part and releasably receivable by the slot, the latch device comprising a pair of spaced-apart fingers projecting from an outer portion of the second part and a tab projecting from an outer portion of the second part, the tab being positioned between the fingers, the fingers projecting generally linearly and parallel with respect to each other, the fingers having outer surfaces which define a plane and which face generally away from a main portion of the second part, the tab having a base, a first leg and a second leg, the base projecting from the second part in a direction generally parallel to the fingers, the first leg extending away from the plane from a first end joined to the base to a second end joined to the second leg, the second leg extending towards the plane and away from the first leg, the latch device, when fully inserted in the slot, being pivotally engagable with the slot side walls and being pivotal with respect to the side walls.

2. The coupling assembly of claim 1, wherein:

the first and second legs form an apex which is spaced apart from the plane of the fingers.

3. The coupling assembly of claim 1, wherein:

the first part forms a pair of ramp surfaces adjacent to the ends of the slot, the ramp surfaces being engagable with the fingers to help guide the latch device into the slot.

4. The coupling assembly of claim 1, wherein:

the first leg engages an edge of the slot when the latch device is fully received by the slot, and the tab is biased to urge the latch device into the slot.

5. The coupling assembly of claim 1, wherein:

the second leg engages an edge of the slot when the latch device is being inserted into the slot, and the tab deflects towards said plane as the latch device is inserted into the slot.

6. The coupling assembly of claim 1, wherein:

the fingers engage the end walls of the slot and deflect towards each as the latch device is inserted into the slot.

7. The coupling assembly of claim 1, wherein:

at least one latch device and slot is located at opposite ends of the first and second parts, each latch device forming a pivot axis about which the second part can pivot and whereby either end of the second part may be lifted away from the first part.

8. The coupling assembly of claim 1, wherein:

at least one latch device and slot is located at opposite ends of the first and second parts, and all the latch devices can be removed from their corresponding slots to completely remove the second part from the first part.

9. The coupling assembly of claim 1, wherein:

as the latch device is inserted into the slot, the fingers engage one of the side walls of the slot, and the second leg engages an opposite side wall of the slot and deflects towards said plane.

10. A coupling assembly for coupling a first part to a second part, comprising:

a plurality of elongated slots formed in the first part, at least one of said slots being located at a first end of the first part and at least one of said slots being located at a second end of the first part opposite of said first end, each slot having first and second spaced apart substantially parallel longer side walls joined together at opposite ends thereof by a pair of shorter end walls; and a plurality of latch devices projecting from the second part, at least one of said latch devices being located at a first end of the second part and at least one of said latch devices being located at a second end of the second part opposite of said first end, each latch device being releasably receivable by a corresponding one of the slots, each latch device comprising a pair of spaced-apart fingers projecting from an outer portion of the second part and a tab projecting from an outer portion of the second part, the tab being positioned between the fingers, the fingers projecting generally linearly and parallel with respect to each other, the fingers having outer surfaces which define a plane and which face generally away from a main portion of the second part, the tab having a base, a first leg and a second leg, the base projecting from the second part in a direction generally parallel to the fingers, the first leg extending away from the plane from a first end joined to the base to a second end joined to the second leg, the second leg extending towards the plane and away from the first leg, the latch device, when fully inserted in the slot, being pivotally engagable with the slot side walls and being pivotal with respect to the side walls.

11. The coupling assembly of claim 10, wherein:

the first and second legs form an apex which is spaced apart from the plane of the fingers.

12. The coupling assembly of claim 10, wherein:

the first part forms ramp surfaces adjacent to the ends of each slot, the ramp surfaces being engagable with the fingers to help guide the latch devices into the corresponding slot.

13. The coupling assembly of claim 10, wherein:

the first leg engages an edge of the slot when the latch device is fully received by the slot, and the tab is biased to urge the latch device into the slot.

14. The coupling assembly of claim 10, wherein:

the second leg engages an edge of the slot when the latch device is being inserted into the slot, and the tab deflecting towards said plane as the latch device is inserted into the slot.

15. The coupling assembly of claim 10, wherein:

the fingers engage the end walls of the corresponding slot and deflect towards each as the latch device is inserted into said slot.

16. The coupling assembly of claim 10, wherein:

each latch device pivotally coupling the second part to the first part, whereby either end of the second part may be lifted away from the first part.

17. The coupling assembly of claim 10, wherein:

all the latch devices can be removed from their corresponding slots to completely remove the second part from the first part.

18. The coupling assembly of claim 10, wherein:

as each latch device is inserted into the corresponding slot, the fingers engage one of the side walls of the corresponding slot, and the second leg engages an opposite side wall of the corresponding slot and deflects towards said plane.

19. A coupling assembly for coupling a first part to a second part, comprising:

an opening in the first part, the second part covering said opening, the first part forming a plate which surrounds and extends away from the opening;

an elongated slot formed in the plate spaced apart from and adjacent to the opening, the slot having first and second spaced apart substantially parallel longer side walls joined together at opposite ends thereof by a pair of shorter end walls, one of the side walls forming an inner edge of a portion of the plate, and a portion of the plate adjacent to said one side wall extending only outwardly away from the slot and extending generally perpendicularly to a surface of said one side wall; and a latch device projecting from the second part and releasably receivable by the slot, the latch device comprising a pair of spaced-apart fingers projecting from an outer portion of the second part and a tab projecting from an outer portion of the second part, the tab being positioned between the fingers, the fingers projecting generally linearly and parallel with respect to each other, the fingers having outer surfaces which define a plane and which face generally away from a main portion of the second part, the tab having a base, a first leg and a second leg, the base projecting from the second part in a direction generally parallel to the fingers, the first leg extending away from the plane from a first end joined to the base to a second end joined to the second leg, the second leg extending towards the plane and away from the first leg the latch device, when inserted into the slot, being pivotally engagable with respect to the side walls of the slot has been inserted.

* * * * *